United States Patent [19]

Dahlgrün

[11] 4,403,619

[45] * Sep. 13, 1983

[54] METHOD AND APPARATUS FOR INFLUENCING THE PERMEABILITY OF WRAPPERS OF FILTER CIGARETTES OR THE LIKE

[75] Inventor: Rolf Dahlgrün, La Celle-St. Cloud, France

[73] Assignee: Hauni-Werke Körber & Co. KG, Hamburg, Fed. Rep. of Germany

[ * ] Notice: The portion of the term of this patent subsequent to Aug. 11, 1998, has been disclaimed.

[21] Appl. No.: 255,460

[22] Filed: Apr. 20, 1981

Related U.S. Application Data

[62] Division of Ser. No. 81,314, Oct. 3, 1979, Pat. No. 4,282,889.

[30] Foreign Application Priority Data

Oct. 18, 1978 [DE] Fed. Rep. of Germany ..... 2845342

[51] Int. Cl.[3] ..... A24C 5/00

[52] U.S. Cl. ..... 131/280; 131/281; 131/90; 131/906; 131/907; 131/908

[58] Field of Search ..... 131/281, 90, 94, 95, 131/29, 32, 35, 37, 67-69, 280

[56] References Cited

U.S. PATENT DOCUMENTS

| | | | |
|---|---|---|---|
| 3,847,044 | 11/1974 | Rudsizinat | 83/866 |
| 4,121,595 | 10/1978 | Hertmann et al. | 131/281 |
| 4,219,727 | 8/1980 | Bolt | 131/281 |

*Primary Examiner*—V. Millin

*Attorney, Agent, or Firm*—Kontler, Grimes & Battersby

[57] ABSTRACT

Discrete uniting bands which are used in a filter tipping machine to connect filter plugs with plain cigarettes consist of foraminous material, and the permeability of such material is varied, when necessary, by changing the quantity of adhesive which is applied to the uniting bands prior to convolution around the respective plain cigarettes and filter plugs. This ensures that each convoluted uniting band admits a preselected quantity of cool atmospheric air into the column of tobacco smoke when the respective filter cigarette is lighted. The paster which applies adhesive to a continuous web which is about to be subdivided into uniting bands is adjusted in response to signals which are generated by a testing device for the wrappers of successive filter cigarettes. If the permeability is too high, the paster is adjusted by reducing or increasing the quantity of adhesive which is applied to successive unit areas or unit lengths of the running web. This can be achieved by changing the thickness of the layer of adhesive or by changing the area of that portion of each unit length of the web which is coated with adhesive.

24 Claims, 7 Drawing Figures

METHOD AND APPARATUS FOR INFLUENCING THE PERMEABILITY OF WRAPPERS OF FILTER CIGARETTES OR THE LIKE

This application is a division of application Ser. No. 081,314, filed Oct. 3, 1979, now U.S. Pat. No. 4,282,889.

BACKGROUND OF THE INVENTION

The present invention relates to a method and apparatus for influencing the permeability of wrapping material for rod-shaped articles which constitute or form part of smokers' products. More particularly, the invention relates to a method and apparatus for influencing the permeability of wrapping material which is to be at least partially coated with an adhesive. Typical examples of materials which can be treated in accordance with the method of and in the apparatus of the present invention are continuous webs of cigarette paper, imitation cork and like wrapping materials which are subdivided into uniting bands for attachment of filter plugs or mouthpieces to plain cigarettes, cigars, cheroots or cigarillos. However, the method and apparatus of the present invention can be practiced with equal advantage in connection with the treatment of other types of porous wrapping materials which are used in the tobacco processing industry as wrappers of rod-like fillers consisting of natural, reconstituted or substitute tobacco and/or filter material for tobacco smoke. The rod-shaped articles which embody or are confined in portions of such wrapping material can constitute plain or filter cigarettes, cheroots, cigars or cigarillos and/or filter rod sections.

The popularity of gas-permeable wrapping material in the tobacco processing industry is on the increase since the discovery, or general acceptance of the belief, that the admixture of cool atmospheric air to tobacco smoke is likely to reduce the deleterious effects of tobacco smoke upon the health of a smoker. Atmospheric air can be admitted into tobacco smoke through pores or holes which are substantially uniformly distributed in the entire wrapping material and/or through holes or perforations which are machined into the wrapping material by resorting to one or more laser beams, sets of needles, spark generators and/or combinations of such and/or other perforating devices. In other words, the permeability of wrapping material is attributable to the porosity of such material alone, to the porosity and machine-made perforations, or solely to the presence of machine-made perforations. As a rule, perforations in the wrappers of filter cigarettes, cigars or cigarillos are formed in the wrappers of filter plugs close to the point where a filter plug abuts against the tobacco-containing part of the smokers' product. This suffices to ensure the inflow of requisite quantities of cool atmospheric air so as to exert a presumably beneficial influence upon the percentage of nicotine and condensates. The quantity of cool atmospheric air which is admixed to tobacco smoke should be maintained at a constant value, i.e., the permeability of each and every increment of the wrapping material (or at least of those portions of wrapping material which are intended to admit atmospheric air into the interior of the smokers' product) should be predictable and should match or very closely approximate a desirable optimum permeability. As a rule, the ratio of cool atmospheric air to tobacco smoke in the column of gaseous fluid that enters a smokers' mouth varies from brand to brand but should remain constant in a given brand of cigarettes, cigars or cigarillos. Even minor fluctuations in the permeability of wrappers of smokers' products of a given type are highly undesirable in view of the presumption that a certain minimum amount of cool air in the column of tobacco smoke is likely to greatly reduce the dangerous effects of smoke upon the health of a smoker.

Commonly owned German Offenlegungschrift No. 2,724,643 discloses a machine for the production of rod-shaped smokers' products wherein the wrappers of such products are tested for permeability and the apparatus for making holes or perforations is adjusted when the monitored permeability deviates from an optimum value. The testing is carried out by a pneumatic monitoring unit which establishes a pressure differential between the interior and exterior of the wrappers of successive articles and ascertains whether or not the pressure differential deviates from a range which is indicative of acceptable permeability. The higher pressure can be established in the interior of or around the wrapper, and the lower pressure can equal or be less than atmospheric pressure. Such procedure is acceptable when the manufacturer of cigarettes or the like is satisfied with a machine (e.g., a filter tipping machine) which is equipped with means for making perforations in a web of wrapping material and with means for adjusting the perforating means in dependency on the results of the testing operation.

On the other hand, many manufacturers of cigarettes or the like prefer to purchase wrapping material of certain permeability, i.e., a material whose permeability is or should be satisfactory to ensure the admission of a predetermined quantity of cool atmospheric air into the column of tobacco smoke. Thus, wrapping material of acceptable or presumably acceptable permeability is furnished by the manufacturer of such material. The manufacturer of wrapping material can furnish webs whose permeability matches or very closely approximates the desired permeability. Nevertheless, testing of smokers' products which include portions of such permeable wrapping material (in the form of wrappers of plain cigarettes, cheroots, cigars or cigarillos, in the form of wrappers of filter plugs or filter mouthpieces and/or in the form of uniting bands which cannot filter plugs or mouthpieces to plain cigarettes, cheroots, cigars or cigarillos) invariably or almost invariably reveals the presence of smokers' products wherein the permeability of wrappers deviates from an optimum permeability, i.e., the quantity of cool atmospheric air which is admitted to and mixes with the column of tobacco smoke does not match the desired optimum quantity. Such deviations of desirable permeability from actual permeability are especially frequent in filter tipped smokers' products, e.g., in filter cigarettes wherein plain cigarettes are connected with filter plugs or mouthpieces by means of foraminous adhesive-coated uniting bands. The permeability of such uniting bands is attributable to the porosity of wrapping material of which the uniting bands consist (such material normally includes cigarette paper webs or webs made of imitation cork) and/or to the presence of holes which are formed by mechanical and/or other means including lasers and spark generators.

OBJECTS AND SUMMARY OF THE INVENTION

An object of the invention is to provide a novel and improved method of regulating the permeability of wrappers of rod-shaped articles which form part of or constitute smokers' products in such a way that the ratio of inflowing cool atmospheric air to tobacco smoke invariably equals or very closely approximates a desired or optimum ratio.

Another object of the invention is to provide a novel and improved method of varying the permeability of wrapping material prior to conversion of such material into tubular envelopes of rod-shaped articles which constitute or form part of smokers' products.

A further object of the invention is to provide a novel and improved method of reducing the permeability of wrapping material for cigarettes or the like prior to conversion of such wrapping material into discrete wrappers for portions of or entire rod-shaped smokers' products.

An additional object of the invention is to provide a method of the above outlined character which can be utilized to vary the permeability of wrapping material irrespective of whether the permeability is attributable to innate or inherent porosity of the wrapping material, to the presence of artificially produced holes or perforations, or both.

Another object of the invention is to provide a method which can be practiced by resorting to simple, compact and relatively inexpensive apparatus to ensure that the permeability of the wrapper of each and every one of a long series of rod-shaped smokers' products matches or very closely approximates the desired value.

A further object of the invention is to provide a novel and improved machine which can be used for the manufacture of rod-shaped articles which constitute or form part of smokers' products and which permit requisite quantities of cool atmospheric air to enter the column of tobacco smoke.

An additional object of the invention is to provide a machine for the production of filter tipped cigarettes, cigars or cigarillos with wrappers which exhibit the aforediscussed desirable characteristics.

A further object of the invention is to provide a novel and improved paster for use in a machine for the production of rod-shaped articles which form part of or constitute smokers' products.

An additional object of the invention is to provide a novel and improved combination of a testing unit and paster for use in filter tipping and other machines for the production of rod-shaped articles which form part of or constitute smokers' products.

Another object of the invention is to provide a novel and improved apparatus for reducing the inherent or artificially created permeability of wrapping material for plain or filter tipped cigarettes, cigars, cheroots, cigarillos and/or filter rod sections.

One feature of the invention resides in the provision of a method of varying the permeability of foraminous wrapping material for rod-shaped commodities which form part of or constitute smokers' products. The method comprises the steps of (a) coating at least a portion of one side of the wrapping material (e.g., a continuous web of cigarette paper which moves lengthwise) with a suitable adhesive which may be a heat-hardenable wet adhesive or a hotmelt), (b) converting the thus coated wrapping material into open-ended tubular wrappers of rod-shaped commodities (this step can include subdividing the moving web into discrete uniting bands and convoluting each uniting band around a rod-shaped commodity consisting of several coaxial articles including at least one article containing filter material for tobacco smoke and at least one article containing natural, reconstituted or substitute tobacco), (c) testing the wrappers with air or another gaseous testing fluid, including establishing a pressure differential between the interior and the exterior of each wrapper and generating first signals (e.g., electric signals) denoting the rate of flow of testing fluid through the wrappers (the pressure in the interior of the wrappers can exceed the pressure around the wrappers or vice versa, and the higher pressure may but need not exceed atmospheric pressure), (d) comparing the first signals with a second signal or reference signal denoting the desired or optimum rate of flow of testing fluid through the wrappers and generating third signals denoting the difference, if any, between the first signals and the second signal, and (e) varying the quantity of adhesive which is applied per unit area of the one side of the wrapping material as a function of (the intensity and/or another characteristic of) the third signals to thereby vary the permeability of the wrappers.

The varying step may include changing the thickness of the layer or layers of adhesive which is applied to the one side of the wrapping material or changing the extent to which the unit areas of the one side of the wrapping material are coated with adhesive. In the latter instance, the coating step preferably comprises applying to each unit area of the wrapping material a pattern of adhesive which covers a portion of the respective unit area, and the changing step then comprises increasing or reducing the ratio of the area of the pattern to the respective unit area. In other words, the coating step may include applying adhesive to the entire one side of the wrapping material (especially if the varying step includes changing the thickness of the adhesive layer at the one side of the wrapping material) or to selected portions of the one side so as to form the aforementioned patterns.

The wrappers are preferably transported sideways in the course of the testing step.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
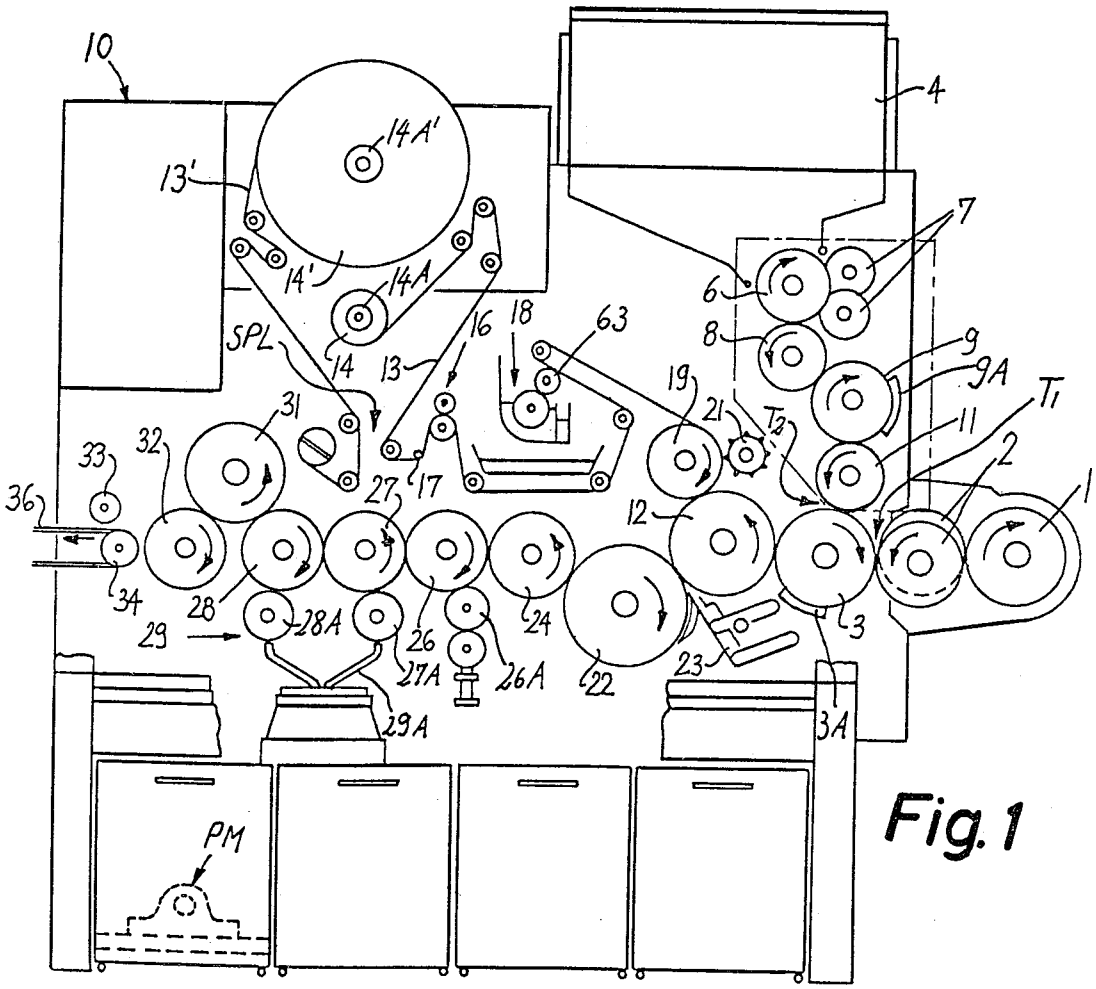
FIG. 1 is a schematic front elevational view of a filter tipping machine including an apparatus which embodies one form of the invention.

FIG. 1 shows a filter tipping machine of the type known as MAX S which is produced by the assignee of the present application. This machine is directly coupled with a cigarette making machine (e.g., a machine of the type known as GARANT, also manufactured by the assignee of the present application) which includes a rotary drum-shaped row forming conveyor 1 having peripheral flutes and serving to accumulate and move sideways two rows of plain cigarettes of unit length. The cigarettes of one row are nearer to one axial end of the conveyor 1 and are disposed in the oddly numbered flutes, and the cigarettes of the other row are nearer to the other axial end of the conveyor 1 and are located in the evenly numbered flutes.

The conveyor 1 is rotatably mounted in the frame 10 of the filter tipping machine and delivers the two rows of plain cigarettes to two discrete rotary drum-shaped aligning conveyors 2 which are driven at different speeds and/or transport the plain cigarettes of the respective rows through different distances so that they deliver pairs of coaxial plain cigarettes into successive flutes of a rotary drum-shaped assembly conveyor 3. The transfer station where the aligning conveyors 2 deliver pairs of coaxial plain cigarettes into successive flutes of the assembly conveyor 3 is shown at T1. The plain cigarettes of the two rows are preferably spaced apart from each other, as considered in the axial direction of the conveyors 1, 2 and 3. The width of clearances between the cigarettes of pairs of plain cigarettes in the flutes of the assembly conveyor 3 at least matches the length of a filter plug of double unit length.

The upper portion of the frame 10 carries a magazine 4 for a supply of parallel filter rod sections of six times unit length. The outlet of the magazine 4 receives a portion of a rotary drum-shaped severing conveyor 6 whose peripheral flutes remove discrete filter rod sections and transport them past two rotary disk-shaped knives 7 so that each filter rod section yields three coaxial filter plugs or mouthpieces of double unit length. The knives 7 are staggered with respect to each other, as considered in the axial and circumferential directions of the severing conveyor 6. The latter delivers sets of three coaxial filter plugs each into the peripheral flutes of three discrete disks which together constitute a staggering conveyor 8. The disks of the staggering conveyor 8 shift the respective filter plugs in the circumferential direction of the illustrated disk so that each set of three originally coaxial filter plugs is converted into a staggered set wherein the three filter plugs are disposed one behind the other. The disks of the staggering conveyor 8 deliver filter plugs into successive flutes of a rotary drum-shaped shuffling conveyor 9 which moves the filter plugs through the space between the stationary cams 9A so as to convert the staggered filter plugs into a single row wherein each preceding filter plug is in exact alignment with the next-following filter plug.

Successive filter plugs of the thus obtained orderly row are transferred into the peripheral flutes of a rotary drum-shaped accelerating conveyor 11 which delivers the filter plugs into successive flutes of the assembly conveyor 3 at a second transfer station T2 located ahead of the station T1, as considered in the direction of rotation of the conveyor 3. The conveyor 11 inserts successive filter plugs in such a way that, when a filter plug reaches and advances beyond the transfer station T1, it is located between two coaxial plain cigarettes of unit length. The thus obtained groups or commodities of three coaxial rod-shaped articles each (namely, a filter plug of double unit length and two plain cigarettes of unit length) are advanced between two stationary condensing cams 3A which move the plain cigarettes axially toward and into abutment with the respective ends of the associated filter plug. The condensed groups are delivered into the peripheral flutes of a feeding device here shown as a rotary drum-shaped transfer conveyor 12.

The frame 10 also supports a reel 14 for a supply of convoluted wrapping material which constitutes an elongated foraminous (e.g., perforated) web 13 consisting of cigarette paper, imitation cork or the like. The means for drawing the web 13 off the reel 14 comprises two advancing rolls 16, at least one of which is driven by the prime mover PM of the filter tipping machine to move the web 13 past the relatively sharp edge of a curling device 17 whose purpose is to eliminate or equalize the internal stresses in the web 13. A curling device which can be used in the filter tipping machine of FIG. 1 is disclosed in commonly owned U.S. Pat. No. 3,962,957 granted June 15, 1976 to Alfred Hinzmann. The reel 14 is mounted on a spindle 14A which is installed in or on the frame 10. A second spindle 14A' carries a fresh reel 14' containing a supply of convoluted wrapping material which forms a second or fresh web 13'. The leader of the fresh web 13' is held in a position of readiness at a splicing station SPL so that it can be attached to the running web 13 as soon as the diameter of the expiring reel 14 is reduced to a predetermined value. A splicing device, which can be installed at the station SPL to automatically or semiautomatically attach the leader of the web 13' to the running web 13 when the supply of web 13 constituting the reel 14 is nearly exhausted, is disclosed in commonly owned U.S. Pat. No. 3,730,811 granted May 1, 1973 to Gerd-Joachim Wendt.

The leader of the running web 13 adheres to the foraminous peripheral surface of a rotary suction drum 19 which draws the web 13 past a roller-shaped applicator 63 forming part of a coating means or paster 18 which costs one side of the web 13 with a suitable adhesive. The adhesive can coat selected portions of or the entire one side of the web 13. The suction drum 19 cooperates with the knives of a rotary cutting drum 21 which severs the leader of the web 13 at regular intervals so that the web 13 yields a succession of adhesive-coated uniting bands serving to sealingly connect filter plugs of double unit length to the respective pairs of plain cigarettes, i.e., to convert each commodity or group into a filter cigarette of double unit length.

The suction drum 19 rotates at a peripheral speed which slightly exceeds the speed of lengthwise movement of the web 13 under the action of the advancing rolls 16 whereby the freshly severed uniting bands are separated from the leader of the web 13 to allow for more convenient attachment of such uniting bands to successive groups in the flutes of the transfer conveyor 12. The uniting bands are preferably attached in such a way that they extend substantially tangentially of the respective groups so that each thereof is in substantially linear contact with the entire filter plug as well as with the adjacent inner end portions of the respective plain cigarettes of unit length.

The transfer conveyor 12 delivers successive groups (each of which carries a uniting band) to a first rolling device 22 which comprises or constitutes a rotary drum-shaped conveyor serving to advance the groups past a normally stationary second rolling device 23. The rolling devices 22 and 23 define a gap normally having a width which at most equals the diameter of a group so that, when a group advances through the gap, it is caused to rotate about its own axis to thereby convert the corresponding uniting band into a tube which sealingly connects the filter plug to the adjacent end portions of the associated plain cigarettes of unit length. The conveyor of the rolling device 22 delivers successive cigarettes of double unit length into successive peripheral flutes of a rotary drum-shaped drying conveyor 24 which is heated from within to complete the setting of adhesive on the convoluted uniting bands. Such setting begins in the aforementioned gap because the rolling device 22 and/or 23 (preferably the device 23) is also heated from within to promote setting of adhesive which has been applied by the paster 18.

The drying conveyor 24 delivers successive filter cigarettes of double unit length into the peripheral flutes of a rotary drum-shaped severing conveyor 26 which cooperates with a rotary disk-shaped knife 26A to sever each convoluted uniting band midway between its axial ends and to thus convert each filter cigarette of double unit length into two coaxial filter cigarettes Z (see FIG. 2) of unit length. Each filter cigarette of unit length includes one of the plain cigarettes PC, one-half F of the filter plug of double unit length and one-half UB of the convoluted uniting band. Furthermore, the severing conveyor 26 serves to initiate or facilitate the ejection of defective filter cigarettes of unit length and/or double unit length, e.g., of cigarettes wherein the filter plug and/or one of the plain cigarettes is missing or of groups which are devoid of uniting bands so that they cannot be converted into filter cigarettes.

The filter plugs of pairs of filter cigarettes of unit length which are formed on the severing conveyor 26 in cooperation with the rotary knife 26A are adjacent to each other. In order to ensure proper testing and/or packing of filter cigarettes of unit length, it is desirable that the filter plugs of all such cigarettes face in the same direction. Therefore, the filter tipping machine comprises a turn-around device 29 which inverts one filter cigarette of each pair end-for-end so that the filter plugs of all filter cigarettes of unit length which advance beyond the turn-around device 29 face in the same direction. The latter comprises a first rotary drum-shaped conveyor 27 whose flutes receive pairs of coaxial filter cigarettes of unit length from the severing conveyor 26. One filter cigarette of each pair is transferred into a flute of a second rotary drum-shaped conveyor 27A of the turn-around device 29 and the other filter cigarettes of successive pairs are transferred, without any inversion, into alternate peripheral flutes of a third rotary drum-shaped conveyor 28 of the device 29. The cigarettes in the flutes of the conveyor 27A are accepted by the orbiting arms 29A of the turn-around device 29 and are moved along arcs of 180 degrees to change their orientation prior to insertion into successive flutes of a fourth rotary drum-shaped conveyor 28A of the device 29. The conveyor 28A delivers inverted filter cigarettes into empty flutes of the conveyor 28 (preferably into the spaces between the non-inverted cigarettes) so that the conveyor 28 transports a single row of filter cigarettes of unit length wherein all of the filter plugs (of unit length) face in the same direction. Such filter cigarettes are transferred onto a rotary drum-shaped conveyor 31 which forms part of a testing device for monitoring the condition of wrappers of successive filter cigarettes of unit length. Filter cigarettes having defective wrappers (e.g., wrappers with large holes, open seams or frayed ends) are ejected during transport in the flutes of a rotary drum-shaped ejecting conveyor 32 which receives filter cigarettes from the conveyor 31. If desired, the conveyor 32 can form part of a further testing device which monitors the tobacco-containing ends of successive filter cigarettes of unit length and initiates the segregation of cigarettes having tobacco containing ends which are too dense or too soft. The ejecting conveyor 32 deposits satisfactory filter cigarettes of unit length onto the upper reach of a belt conveyor 36 which is trained over pulleys 34 (one shown). The illustrated pulley 34 cooperates with a braking drum 33. The filter cigarettes on the upper reach of the belt conveyor 36 are delivered to a packing machine, to storage, to a pneumatic conveyor system which shoots the cigarettes to a remote packing machine, or to a machine for temporary storage of cigarettes, e.g., a machine known as Resy and manufactured by the assignee of the present application.

Figure 2:
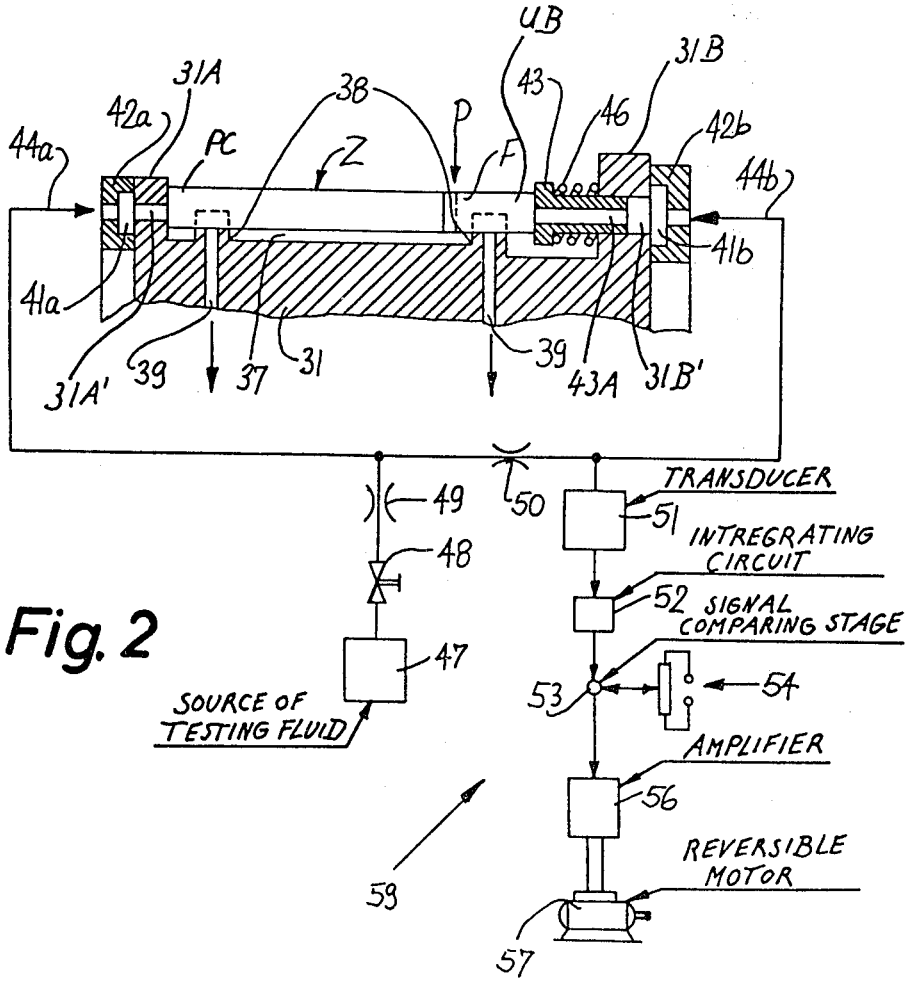
FIG. 2 a fragmentary partly schematic and partly sectional view of a testing unit which is installed in the filter tipping machine of FIG. 1 and constitutes a component of the improved apparatus.

FIG. 2 illustrates the details of the testing apparatus which includes the rotary drum-shaped conveyor 31 of FIG. 1. The periphery of the conveyor 31 is formed with several equidistant axially parallel article-receiving flutes 37, each having a pair of lands 38 whose concave outer surfaces support the filter cigarettes Z in such a way that the major portion of the open-ended tubular wrapper of each cigarette Z is spaced apart from the conveyor 31. This ensures that the testing apparatus can detect all or nearly all defects in the wrappers of the cigarettes Z, i.e., the only undetected holes of the wrappers are those which happen to overlie the concave surfaces of the lands 38. Each of these lands is formed with at least one suction port 39 which communicates with a suction generating device (e.g., a fan, not shown) during travel of the respective flute from the transfer station between the conveyors 28, 31 to the transfer station between the conveyors 31, 32. The means for regulating the connections between the ports 39 of the lands 38 and the suction generating device comprises a customary valving element which is not shown because it is well known from the art of filter tipping machines. As mentioned hereinbefore, the machine which is shown in FIG. 1 and which includes the testing apparatus of FIG. 2 is known as MAX S and is manufactured and sold by the assignee of the present invention.

The body of the drum-shaped conveyor 31 is formed with flanges 31A and 31B which are adjacent to stationary valve plates **42*a* and 42*b*. These valves plates have slots 41*a* and 41*b* which are located opposite each other and define the length of the testing station, as considered in the circumferential direction of the conveyor 31. The flanges 31A and 31B are respectively formed with annuli of bores 31A' and 31B', each of which is in register with a different flute 37. The bores travel past and communicate seriatim with the associated slots 41*a*, 41*b* when the conveyor 31 is driven by the main prime mover PM of the filter tipping machine. The bores 31B' of the flange 31B contain reciprocable nipples 43 which are biased in a direction to the left, as viewed in FIG. 2, by helical springs 46 reacting against the flange 31B. Suitable roller followers (not shown) on the nipples 43 cooperate with a stationary ring cam (not shown) to shift the nipples 43 in a direction to the left at the transfer station between the conveyors 28, 31 so that a filter cigarette Z which has been deposited into the respective flute 37 and is attracted by suction in the corresponding ports 39 is pushed toward and into abutment with the flange 31A during travel toward, past and beyond the slots 41***a* and 41*b*. The nipples 43 have axial bores 43A which communicate with the slot 41*b* during travel past the testing station. At the same time, the open left-hand ends of the wrappers of cigarettes Z (which abut against the flange 31A) communicate with the slot 41*a* via corresponding bores 31A' of the flange 31A. As shown, the cigarettes Z are preferably transferred onto the conveyor 31 in such a way that their tobacco-containing ends abut against the flange 31A and their filter plugs F (of unit length) abut against the respective nipples 43.

The testing apparatus further comprises a source 47 of compressed testing fluid (e.g., air) which is connected with two conduits 44*a* and 44*b* by way of an adjustable flow regulating valve 48 and a preferably adjustable flow restrictor 49. The conduit 44*b* further contains a preferably adjustable flow restrictor 50. This renders the testing apparatus more sensitive in the region (shown at P) where the convoluted uniting band UB is perforated to admit cool atmospheric air into the column of tobacco smoke when the filter cigarette Z is lighted. The conduit 44*a* admits compressed air into the slot 41*a* of the valving element 42*a*, and the conduit 44*b* admits compressed air into the slot 41*b* of the valving element 42*b*. Thus, the testing apparatus of FIG. 2 is of the type wherein the compressed testing fluid issuing from the conduits 44*a*, 44*b* raises the pressure in the interior of the wrappers of filter cigarettes Z above atmospheric pressure if the wrappers of the filter cigarettes are satisfactory. If not, the drop in pressure differential (i.e., the increased rate of flow of gaseous testing fluid through the convoluted uniting band UB) is detected by a suitable electropneumatic transducer 51 which transmits an electric signal to an integrating circuit 52 which, in turn, transmits an integrated signal denoting the permeability of a selected number of successively tested wrappers of filter cigarettes Z to one input of a signal comparing stage 53. The region P of the uniting band UB is also called the climatic zone; this region can be formed with intentionally produced perforations or holes which are provided in the web 13 before the latter is subdivided into discrete uniting bands. The perforations may be made by one or more lasers, by mechanical perforating instrumentalities, by spark generators and/or in any other suitable way. Reference may be had to commonly owned U.S. Pat. No. 3,483,873 granted Dec. 16, 1969 to Alfred Hinzmann which discloses an apparatus for making perforations in a web of cigarette paper or the like by mechanical means, and to copending patent applications Ser. Nos. 841,108 and 864,441 respectively filed on Oct. 11, 1977 and Dec. 27, 1977 by Wahle et al. and Lüders et al. which disclose apparatus for making perforations by means of lasers and spark generating devices. The transducer 51 may be a capacitive diaphragm transducer of the type disclosed in commonly owned U.S. Pat. No. 3,412,856 granted Nov. 26, 1968 to Alfred Esenwein. The exact construction of the integrating circuit 52 forms no part of the invention; all that counts is to utilize a circuit which is capable of evaluating the signals which are generated by the transducer 51 and of transmitting signals which are indicative of the permeability of the entire wrappers or of portions of wrappers of a selected number of successive filter cigarettes Z. The wrappers of certain filter cigarettes Z may be defective due to the presence of open seams, holes in the tobacco-surrounding and/or filter material-surrounding portions of the wrappers, frayed ends and/or a combination of such defects. In view of the provision of flow restrictor means 50 in the conduit 44*b*, signals which are generated by the integrating circuit 52 are indicative (either in general or exclusively) of the average permeability of the right-hand portions of a given number of wrappers of successive filter cigarettes Z, i.e., of those portions which include the foraminous regions P. If the wrapper of a filter cigarette Z is not defective as a result of the presence of holes in those portions of the wrappers which flank the respective regions P, the intensity or another characteristic of the signal which the integrating circuit 52 transmits to the corresponding input of the signal comparing stage 53 is indicative of the average permeability of a given number of permeable regions or portions P. Another input of the stage 53 receives reference signals from a suitable source 53 (e.g., an adjustable potentiometer). Such reference signals denote the desired or optimum permeability of the regions P of the wrappers of a given number of successively tested filter cigarettes Z. If the intensity of the reference signal which is transmitted by the source 54 deviates from the intensity of the signal which is transmitted by the output of the integrating circuit 52, the stage 53 transmits a signal to a control unit 56 (e.g., an amplifier) for a reversible adjusting motor 57 whose purpose will be described in connection with FIG. 3. The parts 52, 53 and 54 together constitute an evaluating circuit 59 which actuates the reversible motor 57 via amplifier 56 in dependency on upward or downward deviations of average permeabilities of a given number of wrapper regions P from that average permeability which has been selected by an appropriate setting of the source 54.

Figure 3:
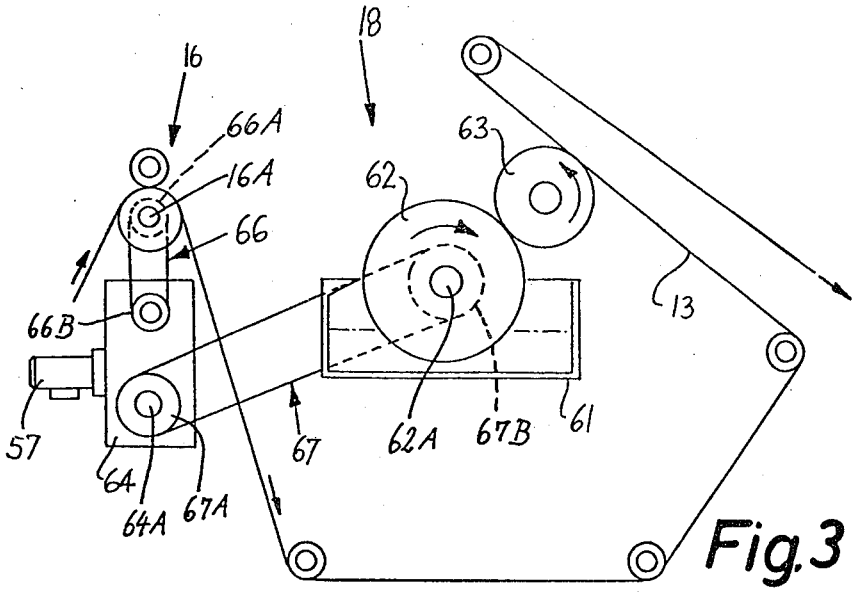
FIG. 3 is an enlarged schematic elevational view of a coating means or paster which also forms part of the machine of FIG. 1 and constitutes another component of the improved apparatus.

The coating means or paster 18 of FIG. 3 comprises a vessel or tank 61 for a supply of adhesive, a first rotary element or transfer roller 62 which dips into the tank 61 and transfers a layer of adhesive from the supply onto the peripheral surface of the aforementioned roller-shaped applicator 63 (second rotary element), and means for driving the transfer roller 62 (which, in turn, transmits torque to the applicator 63) in dependency on the characteristics of signals transmitted by the signal comparing stage 53 of FIG. 2. The underside of the running web 13 contacts the peripheral surface of the applicator 63.

The means for driving the transfer roller 62 receives torque from the main prime mover PM of the filter tipping machine of FIG. 1 via one of the advancing rolls 16. As shown in FIG. 3, the lower advancing roll 16 has a shaft 16A which drives an endless belt conveyor 66 via pulley 66A. The pulley 66B which is driven by the conveyor 66 constitutes the input element of an infinitely variable-speed transmission 64 whose output element 64A drives a pulley 67A for an endless belt conveyor 67 driving a further pulley 67B on the shaft 62A of the transfer roller 62. The ratio of the transmission 64 can be varied by the reversible adjusting motor 57 in response to signals which are transmitted (via amplifier 56) by the signal comparing stage 53.

The operation of the coating means or paster 18 of FIG. 3 and testing apparatus of FIG. 2 is as follows:

Filter cigarettes Z which are transferred into the flutes 37 of the conveyor 31 are tested, one after the other, during transport between the slots 41*a* and 41*b*. The integrating circuit 52 transmits a (first) signal which is indicative of the average permeability of the wrappers of a selected number of successively tested filter cigarettes Z. If the comparison of such (first) signal with the second or reference signal which is supplied by the potentiometer 54 indicates a deviation from the characteristics of the reference signal, the output of the stage 53 transmits a (third) signal to the amplifier 56 which actuates the adjusting motor 57 to change the ratio of the transmission 64. When the average permeability of the wrappers of the selected number of filter cigarettes Z is excessive, the speed of the transfer roller 62 (and hence the speed of the applicator 63) is increased so that the applicator 63 increases the thickness of the layer of adhesive paste which is applied to the underside of the running web 13. The thicker layer of adhesive paste effects a more pronounced sealing action upon those portions of the underside of the web 13 which are coated with adhesive paste, i.e., the permeability of the web 13 is reduced. Inversely, the speed of the transfer roller 62 is reduced when the (third) signal at the output of the stage 53 denotes that the average permeability of a series of successively tested wrappers is too low. This results in a reduction of the thickness of the layer of adhesive paste which is applied to one side of the running web 13, i.e., the permeability of the web 13 is increased upstream of the locus (suction drum 19) where the leader of the web 13 is converted into a succession of discrete adhesive-coated uniting bands UB.

The application of a thicker layer of adhesive paste to selected portions of or to the entire underside of the web 13 which is advanced above the applicator 63 results in more pronounced sealing of pores in the web 13 or in sealing of a larger number of pores. The result is the same, i.e., the permeability of the web 13 decreases. Inversely, the permeability of the running web increases if the number of sealed pores (or the extent to which the pores are sealed) is reduced in response to a reduction of the thickness of the layer of adhesive paste which is applied by the applicator 63.

Figure 4:
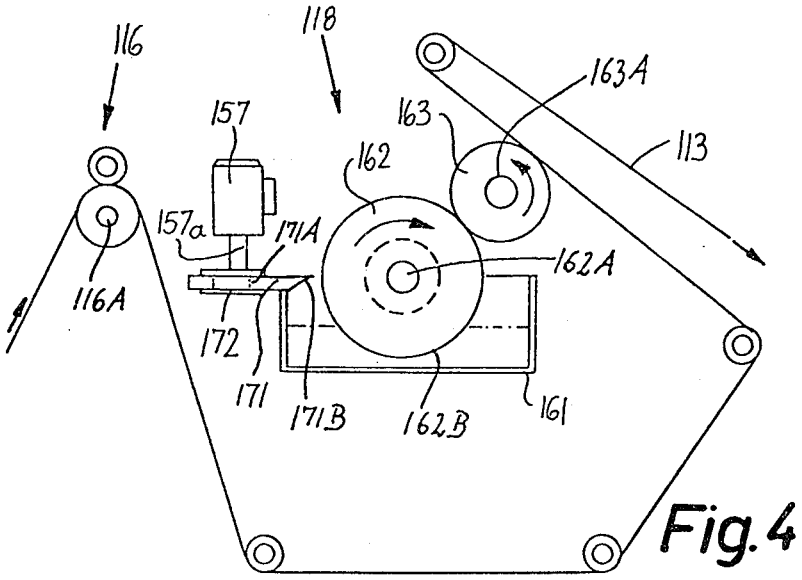
FIG. 4 is a similar schematic elevational view of a second paster.

FIG. 4 shows a modified coating means or paster 118 wherein all such parts which are identical with or clearly analogous to corresponding parts of the paster 18 of FIG. 3 are denoted by similar reference characters plus 100. In this embodiment of the paster, the shafts 116A, 162A and 163A (or at least the shafts 116A and 162A if the applicator 163 is driven by the transfer roller or rotary element 162) receive torque directly from the main prime mover PM of the filter tipping machine of FIG. 1. In other words, the ratio of peripheral speeds of the advancing rolls 116, on the one hand, and the peripheral speeds of the transfer roller 162 and applicator 163, on the other hand, is constant but such peripheral speeds need not be constant. The thickness of the layer of adhesive which the transfer roller 162 draws from the supply in the tank 161 and/or of the layer which the roller 162 transfers onto the applicator 163 cannot be influenced by the advancing rolls 116. Instead, the adjusting motor 157 (whose direction of rotation and the extent of rotation in the clockwise or counterclockwise direction is controlled by the (third) signal at the output of the stage 53 shown in FIG. 2) controls the movements of the edge of a stripping device, here shown as a doctor blade 171, toward or away from the periphery of the roller 162. In this manner, the adjusting motor 157 can regulate the thickness of the adhesive layer which is transferred onto the peripheral surface of the applicator 163 and thence onto the underside of the running web 113. The output shaft 157*a* of the adjusting motor 157 carries an eccentric 172 which is received in a suitably configurated opening 171A of the doctor blade 171 to change thereby the distance between the edge 171B and the peripheral surface 162B of the rotary element or transfer roller 162. The result is the same as described in connection with FIG. 3, i.e., the thickness of the layer of adhesive paste which is applied to the underside of the web 113 advancing past the applicator 163 determines (a) the extent to which the pores of the web 113 are sealed and/or (b) the number of sealed pores per unit area of the web.

Figure 5:
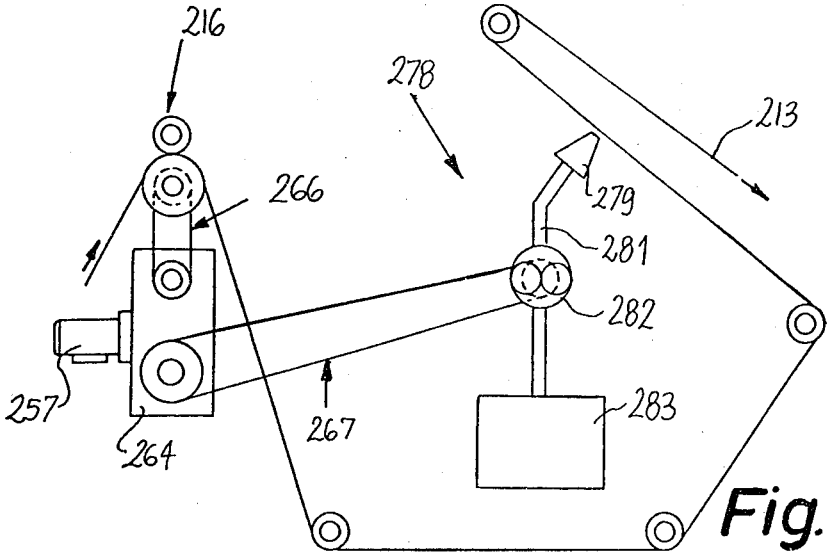
FIG. 5 is a schematic elevational view of a third paster.

FIG. 5 illustrates a third coating means or paster 278, wherein all such parts which are identical with or clearly analogous to corresponding parts of the paster 18 of FIG. 3 are denoted by similar reference characters plus 200. The paster 278 comprises a nozzle 279 which discharges one or more streams of adhesive against the underside of the running web 213. The nozzle 279 receives adhesive from a tank 283 by way of a supply conduit 281 which contains a variable-delivery pump 282, e.g., a suitable gear pump. The rate at which the pump 282 supplies adhesive to the nozzle 279 is a function of the characteristics of the (third) signal which is transmitted by the stage 53 of FIG. 2 to the adjusting motor 257 which varies the ratio of the infinitely variable-speed transmission 264. The endless belt conveyor 267 drives the pump 282, and the input element of the transmission 264 receives torque from the lower advancing roll 216 via endless belt conveyor 266. The thickness of the layer or layers of adhesive which is applied by the nozzle 279 determines the permeability of the running web 213 in dependency on the intensity or another characteristic of the (third) signal transmitted by the stage 53. In other words, such signal controls the rate at which the pump 282 delivers adhesive to successive increments of the web 213 via nozzle 279.

Figure 6:
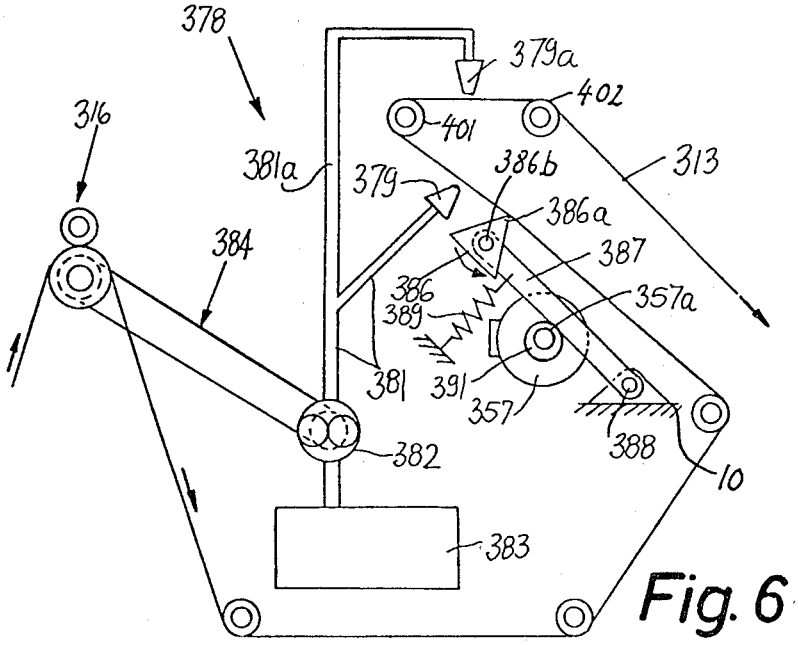
FIG. 6 is a similar schematic elevational view of a fourth paster.

FIG. 6 shows a fourth coating means or paster 378, wherein all such parts which are identical with or analogous to those of the paster 278 of FIG. 5 are denoted by similar reference characters plus 100. The paster 378 comprises a second nozzle 379*a* which is connected with the supply conduit 381 by a second conduit 381*a*. The conduits 381 and 381*a* receive adhesive from the tank 383 at a rate which is determined by the variable-delivery pump 382. The pump 382 is driven by the lower advancing roll 316 via belt transmission 384.

Figure 7:
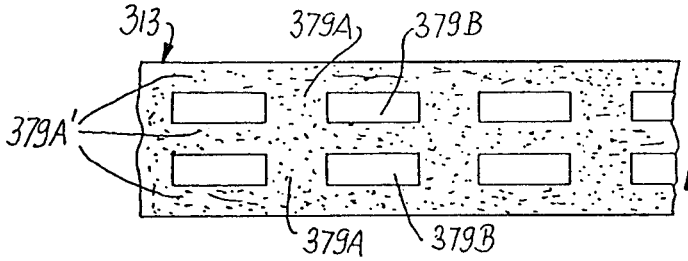
FIG. 7 is an enlarged view of a portion of one side of a web of wrapping material which has been coated with patterns of adhesive during transport along the paster of FIG. 6.

The streams of adhesive which issue from the orifices of the second nozzle 379*a* apply to one side of the running web 313 three discrete layers or strips 379A' of adhesive (see FIG. 7). The orifices of the nozzle 379 discharge adhesive for intermittent (periodically interrupted) coating of those portions of the one side of the web 313 which are not coated by adhesive issuing from the orifices of the nozzle 379*a*. The nozzle 379*a* is fixedly mounted in the frame of the filter tipping machine embodying the paster 378 and the running web 313 is trained over guide rolls 401, 402 which rotate about fixed axes so that the web portion between the rolls 401, 402 invariably advances along a predetermined path. Therefore, the layers 379A' are uninterrupted. These layers include a centrally located layer and two outer layers which coat the marginal portions of the one side of the running web 313. if the two orifices of the nozzle 379 were sufficiently close to the one side of the web 313 at all times, the nozzle 379 would coat those portions of the one side of the web which are disposed between the strips 379A', i.e., the entire one side of the web 313 would be coated with adhesive paste. However, the paster 378 further comprises means for periodically interrupting the application of adhesive by the nozzle 379. The interrupting means comprises a rotary cam 386 with a selected number of lobes (e.g., a substantially triangular cam with three equidistant lobes **386*a*). The means for rotating the cam 386 comprises a camshaft 386*b* which receives torque from the prime mover PM or from another motor and rotates the cam 386 in a counterclockwise direction, as viewed in FIG. 6. The paster 378 further comprises means for regulating the length of intervals during which the lobes 386*a* of the cam 386 maintain the running web 313 out of contact with adhesive which issues from the two orifices of the nozzle 379. The regulating means comprises a lever 387 which carries the shaft 386*b* for the cam 386, a pivot member 388 which articulately connects the lever 387 to the frame 10, and an eccentric 391 which can change the inclination of the lever 387 to determine thereby the total amount of adhesive which is applied to successive unit lengths of the web 313. The eccentric 391 is mounted on the output element 357*a* of the reversible adjusting motor 357 which turns the eccentric 391 clockwise or counterclockwise in response to positive or negative (third) signals from the signal comparing stage 53, i.e., in dependency on the monitored average permeability of a selected number of successively tested filter cigarette wrappers. A helical spring 389 is provided to permanently bias the lever 387 against the peripheral surface of the eccentric 391. This insures that the lever 387 can immediately react to each and every change in angular position of the eccentric 391, i.e., to each and every change in a selected characteristic (e.g., intensity) of the signal which is transmitted by the stage 53**.

In the paster 378 of FIG. 6, the cam 386 disengages the web 313 from the nozzle 379 (or moves the web 313 sufficiently away from the nozzle 379 so that the orifices of this nozzle cannot discharge adhesive upon the web) three times during each revolution of the camshaft **386*b*. Therefore, the orifices of the nozzle 379 apply staggered patches 379A of adhesive paste to that side of the running web 313 which is provided with the strips 379A' consisting of adhesive issuing from the three orifices of the second nozzle 379*a*. The adhesive-free portions or panels 379B at the one side of the running web 313 are shown in FIG. 7. The length of these panels (and hence the quantity of adhesive which is applied to successive unit lengths of the web 313) is a function of angular position of the lever 387 and eccentric 391, i.e., the selected characteristic of the signal which is transmitted by the stage 53 of FIG. 2 determines the extent to which the permeability of the web 313 is reduced by adhesive which has been applied by the nozzle 379. The extent to which the permeability of the web 313 is reduced by the second nozzle 379*a* remains unchanged. Since the nozzle 379 is located ahead of the nozzle 379*a*, as considered in the direction of lengthwise movement of the web 313 under the action of the suction drum 19 (not shown in FIG. 6), the patches or strip portions 379A are applied (and the panels 379B are formed) before the nozzle 379*a* applies the strips 379A'. In other words, the panels 379B are framed by adhesive which issues from the orifices of the second nozzle 379*a***.

If the nature of the signal which is transmitted by the stage 53 is such that the eccentric 391 is caused to pivot the lever 387 in a clockwise direction, as viewed in FIG. 6, the length of intervals during which the lobes **386*a* of the continuously rotating cam 386 maintain the web 313 sufficiently far away from the nozzle 379 to interrupt the formation of discontinuous strips including the portions 379A, the percentage of uncoated portion (panels 379B) of one side of the running web 313 increases, i.e., the permeability of successive unit lengths of the web 313 increases. Inversely, the length of the aforementioned intervals is reduced if the spring 389 is free to pivot the lever 387 in a counterclockwise direction, as viewed in FIG. 6. The area of uncoated portion of the one side of the web 313 is then reduced and the permeability of successive unit lengths of the web is also reduced. It can be said that the areas of patterns of adhesive which are applied to successive unit lengths or unit areas of the web 313 vary as a function of changes in the characteristics of (third) signals which the motor 357 receives from the output of the stage 53**.

The paster 378 of FIG. 6 can be modified in a number of ways without departing from the spirit of the invention. For example, the cam 386 and the means for moving this cam bodily toward and away from the path of the web 313 can be omitted if the motor 357 or an analogous device is used to regulate the rate of admission of adhesive to the nozzle 379. In other words, instead of periodically moving the web 313 away from the orifices of the nozzle 379, the orifices of this nozzle can be placed at such a distance from the path of the web 313 that the latter receives one or more continuous layers of adhesive but the thickness of the continuous layer or layers varies periodically and to a greater or lesser extent, depending on the characteristics of signals from the stage 53. Also, the admission of adhesive paste to the nozzle 379 can be regulated in such a way that the nozzle applies paste at intervals, even though its orifices are sufficiently close to the running web 313 to admit paste at all times when the admission of paste via conduit 381 is not interrupted. The construction which is shown in FIG. 6 is preferred at this time because it is simpler and less expensive than the just described modifications of the paster 378. The regulation of admission of paste to the nozzle 379 is more complex and expensive because such regulation must be carried out by further considering the momentary output of the machine. The RPM of the shaft **386*b* in the paster 378 is synchronized with the RPM of the shaft 316A for the lower advancing roll 316. The upper advancing roll 316 may but need not be driven; in many instances, this roll rotates in response to the action of one or more springs or other suitable means for biasing it against the positively driven lower roll 316. It is clear that the upper advancing roll 316 can be driven and that the belt transmission 384** then receives motion from the upper advancing roll.

An important advantage of the improved method and apparatus is that the permeability of wrapping material can be influenced (reduced) in a simple and inexpensive way, not by varying the dimensions of perforations or holes which are formed while the wrapping material is transported in the machine for the manufacture of portions of or entire rod-shaped smokers' products, but rather by regulating the extent to which the permeability of foraminous wrapping material is changed prior to conversion into tubular envelopes or wrappers of plain or filter tipped cigarettes, cigars, cigarillos, cheroots and/or filter rod sections. In other words, the manufacture of smokers' products can purchase prefabricated foraminous wrapping material and, if the permeability of such prefabricated material deviates from the desired or optimum permeability, the manufacturer of smokers' products can readily change the permeability so as to ensure the admission of requisite quantities of cool atmospheric air into the column of tobacco smoke. The adjustment is simple, readily reproducible, and the number of rejects is low because each and every adjustment entails immediate and fully automatic changes in permeability of successive wrappers.

It will be noted that the quantity of adhesive which is applied to one side of the running web to thereby change the permeability of the web can be varied in two different ways, namely, by changing the thickness of the layer or layers which are applied to one side of the web (this can be achieved by resorting to the pasters which are shown in FIGS. 3, 4 and 5) or by changing the combined areas of those portions of one side of the web which are coated with adhesive (FIG. 6). In the first instance, the permeability of wrapping material is changed by varying the extent to which the pores or holes are sealed. In the second instance, one varies the number of pores or holes per unit area of the web which are sealed by adhesive. As mentioned above, the application of adhesive in accordance with the method of the present invention to a running web of wrapping material which is about to be converted into uniting bands for connection of filter plugs or mouthpieces to plain cigarettes, cigars, cigarillos or cheroots constitutes the presently preferred utilization of the invention. However, it is clear that the same or an analogous procedure can be resorted to for the application of adhesive to wrapping material which is to be draped around rod-like fillers consisting of natural, reconstituted or substituted tobacco and/or filter material.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. A method of influencing the permeability of foraminous wrapping material for rod-shaped commodities which form part of or constitute smokers' products, comprising the steps of coating at least a portion of one side of the wrapping material with adhesive; converting the thus coated wrapping material into open-ended tubular wrappers of rod-shaped commodities; testing the air permeability of the wrappers and generating first signals denoting the measured air permeability of the wrappers; comparing said first signals with a second signal denoting the desired air permeability and generating third signals denoting the difference if any, between said first signals and second signal; and varying the quantity of adhesive which is applied per unit area of said one side of the wrapping material as a function of said third signals to thereby vary the permeability of the wrappers.

2. The method of claim 1, wherein said testing step includes pneumatically testing the permeability of the wrappers.

3. The method of claim 2, wherein the air permeability of the wrapping material is pneumatically tested with a gaseous fluid including establishing a pressure differential between the two sides of the wrappers and generating first signals denoting the rate of flow of testing fluid through the wrappers.

4. The method of claim 1, wherein said varying step includes changing the thickness of adhesive which is applied to said one side of the wrapping material.

5. The method of claim 1, wherein said varying step comprises changing the extent to which the unit areas of said one side of the wrapping material are coated with adhesive.

6. The method of claim 5, wherein said coating step comprises applying to each unit area of said one side of the wrapping material a pattern of adhesive which covers a portion of the respective unit area and said changing step includes increasing or reducing the ratio of the area of the pattern to the respective unit area.

7. The method of claim 1, wherein said wrapping material is a web and said commodities are groups of coaxial rod-shaped articles each including an article which contains filter material and an article which contains tobacco, said converting step including subdividing the coated web into discrete uniting bands and convoluting discrete uniting bands around said groups so that the convoluted uniting bands connect the articles of the respective groups to each other.

8. Apparatus for influencing the permeability of foraminous wrapping material for rod-shaped commodities which constitute or form part of smokers' products, comprising a source of wrapping material; adjustable means for coating at least a portion of one side of said material with an adhesive; means for converting the thus coated wrapping material into open-ended tubular wrappers of rod-shaped commodities; means for testing the air permeability of said material including means for generating first signals denoting the measured air permeability of said material; a source of reference signals denoting the desired air permeability of said material; means for comparing said first signals with said second signals and for generating third signals denoting the differences, if any, between said first and second signals; and means for adjusting said coating means as a function of said third signals to thereby vary the permeability of said material by varying the quantity of adhesive which is applied per unit area of said one side of said material.

9. The apparatus of claim 8, wherein said testing means comprises means for establishing a pressure differential between the two sides of said material sand said generating means comprises means for generating said first signals denoting the rate of flow of testing fluid through said material.

10. The apparatus of claim 9, wherein said testing means further comprises conveyor means for moving said material sideways during said testing.

11. The apparatus of claim 8, wherein said coating means comprises a paster including a source of adhesive, a nozzle having means for applying adhesive to said one side of the wrapping material, and a variable-delivery pump interposed between said source of adhesive and said nozzle, said adjusting means including means for varying the rate of delivery of said pump.

12. The apparatus of claim 11, wherein said wrapping material is an elongated web and further comprising means for advancing the web lengthwise past said nozzle, said means for varying the rate of delivery of said pump including a variable-speed transmission receiving motion from said advancing means and arranged to drive said pump and means for varying the ratio of said transmission as a function of changes in at least one characteristic of said third signals.

13. The apparatus of claim 8, wherein said coating means includes a paster having a source of adhesive and at least one rotary element which transfers adhesive from said source of adhesive to said one side of the wrapping material.

14. The apparatus of claim 13, wherein said wrapping material is an elongated web and further comprising means for advancing the web lengthwise past said rotary element, said adjusting means including a variable-speed transmission receiving motion from said advancing means and arranged to rotate said element and means for varying the ratio of said transmission as a function of changes in at least one characteristic of said third signals.

15. The apparatus of claim 13, wherein said wrapping material is an elongated web and further comprising means for advancing the web past said rotary element, said advancing means comprising at least one rotary member and said adjusting means including means for varying the ratio of the peripheral speed of said member to the peripheral speed of said element.

16. The apparatus of claim 8, wherein said coating means includes a paster having a source of adhesive and at least one rotary element dipping into said source of adhesive and arranged to apply adhesive to said one side of the wrapping material, said adjusting means including a device for varying the thickness of the adhesive film which is withdrawn by said rotary element from said source of adhesive as a function of changes in at least one characteristic of said third signals.

17. The apparatus of claim 16, wherein said device comprises a blade movable toward and away from the peripheral surface of said rotary element and means for moving said blade in response to changes in said characteristic of said third signals.

18. The apparatus of claim 8, wherein said adjusting means includes means for periodically interrupting the application of adhesive to said one side of the wrapping material.

19. The apparatus of claim 18, wherein said adjusting means further comprises means for varying the length of intervals of interruption of the application of adhesive to the wrapping material.

20. The apparatus of claim 19, wherein said wrapping material is an elongated web and further comprising means for advancing the web lengthwise past said interrupting means, said coating means including a source of adhesive and a nozzle receiving adhesive from said source and arranged to apply adhesive to said one side of the web, said interrupting means including means for intermittently increasing the distance between said nozzle and the path of the web so that the adhesive issuing from said nozzle is incapable of reaching said one side when said distance is increased.

21. The apparatus of claim 20, wherein said distance increasing means comprises a rotary cam having at least one lobe which lifts the web off said nozzle and means for driving said cam in synchronism with said advancing means.

22. The apparatus of claim 21, wherein said means for varying the length of intervals of interruption of the application of adhesive comprises means for moving the entire cam toward or away from the path of the advancing web.

23. The apparatus of claim 22, wherein said coating means further comprises a nozzle arranged to apply to the advancing web at least one uninterrupted layer of adhesive.

24. The apparatus of claim 8, wherein said testing means and said coating means are installed in a filter tipping machine for cigarettes or the like and the wrapping material is a continuous web and further comprising means for moving said web lengthwise past said coating means, said converting means including means for subdividing said web into discrete uniting bands downstream of said coating means, as considered in the direction of movement of the web, and means for convoluting said discrete uniting bands around rod-shaped commodities, each of said commodities comprising at least two coaxial rod-shaped articles one of which contains tobacco and the other of which contains filter material for tobacco smoke, the convoluted uniting bands connecting the rod-shaped articles of the respective commodities to each other.

* * * * *